US006397704B1

(12) United States Patent
Olañeta

(10) Patent No.: US 6,397,704 B1
(45) Date of Patent: Jun. 4, 2002

(54) CORKSCREW

(75) Inventor: Santiago Olañeta, Eibar (ES)

(73) Assignee: B. Olaneta Y Juaristi, S.A., Eibar (ES)

( * ) Notice: Subject to any disclaimer, the term of this patent is extended or adjusted under 35 U.S.C. 154(b) by 0 days.

(21) Appl. No.: 09/555,742

(22) PCT Filed: Dec. 3, 1998

(86) PCT No.: PCT/ES98/00329

§ 371 (c)(1),
(2), (4) Date: Jun. 2, 2000

(87) PCT Pub. No.: WO99/31005

PCT Pub. Date: Jun. 24, 1999

(30) Foreign Application Priority Data

Dec. 15, 1997 (ES) ..... 9703240 U

(51) Int. Cl.[7] ..... B67B 7/44
(52) U.S. Cl. ..... 81/3.09; 81/3.47
(58) Field of Search ..... 81/3.09, 3.36, 81/3.39, 3.45, 3.47, 3.56

(56) References Cited

U.S. PATENT DOCUMENTS 4,437,359 A 3/1984 Dejoux et al. ..... 81/3.38
4,759,238 A * 7/1988 Farfalli ..... 81/3.09
4,996,895 A * 3/1991 Puig ..... 81/3.09
5,992,269 A * 11/1999 Puig et al. ..... 81/3.35
6,032,553 A * 3/2000 Puig et al. ..... 81/3.09
6,101,900 A * 8/2000 Miguel ..... 81/3.09 X

FOREIGN PATENT DOCUMENTS

| | | |
|---|---|---|
| EP | 0 860 396 A1 | 8/1998 |
| ES | 1020637 | 3/1992 |
| ES | 1 035 671 | 5/1997 |
| ES | 1 037 056 | 12/1997 |

* cited by examiner

*Primary Examiner*—D. S. Meislin
(74) *Attorney, Agent, or Firm*—Nath & Associates PLLC; Gary M. Nath; Marvin C. Berkowitz

(57) ABSTRACT

Improved corkscrew formed by a metal structure wherein a stop part rests on an bottle outlet, the stop part composed of two parts which are telescopically coupled and which can be locked into an extended position by means of a retaining element actuated by a flexible pusher thereby facilitating a progressive bearing position when removing a cork from said bottle.

13 Claims, 3 Drawing Sheets

CORKSCREW

Among the multiple types of existing manual corkscrews there are those having a grip in which a helicoidal drill is introduced in an articulated way into a cork to be extracted, the corkscrews also having an upper part that rests on the edge of a bottle outlet.

Known corkscrews base their operation on the activation of a type of lever with an intervention point at an end on an outlet edge with resistance in a central area (this is the cork to be extracted) and power applied on another end (power exercised with the user's hand). A corkscrew of this type is the one that constitutes the object of Utility Model 260,177.

These corkscrews have the disadvantage that when a length of the cork is longer than a lever's displacement, it is necessary to take out a first section of the cork and in a second operation, introduce the drill further into the cork, by means of a new lever action to completely extract the cork. Moreover a risk is run that the cork gets cracked and breaks.

To overcome this disadvantage, some solutions use a double stop to allow by means of two different resting points, the complete extraction of the cork without the need to drill deeper a second time. However, known solutions require an annoying manipulation because the change of a top from a first resting point to a second one requires an uncomfortable manipulation for a user since both hands must be used.

In fact, the solution indicated in Utility Model 9200910 made of a first and second support with an articulated shaft wherein the second support is longer than the first support. The user places the first support on the bottle neck and then, once a part of the cork has been taken out, removes the first support and places the second support on the outlet of the bottle neck, thereby completing removal of the cork.

However, when using the above described device, the user requires the use of both hands to situate both resting points correctly. In these circumstances, the bottle has to be reclined somewhere while the operation to change over from the first support to the second one is carried out, which is annoying for the main users of this kind of corkscrew who are professionals from the hotel and restaurant business sector. Customarily, these professionals come close to a table where the bottle is going to be used, hold the bottle in one hand and with the other use the corkscrew to extract the plug. The ideal corkscrew is one that allows the cork to be extracted by only manipulating the corkscrew with one hand.

In Utility Model 9602975, another version of this kind of corkscrew is disclosed, in which a top piece establishes a double support for the corkscrew by incorporating in its central area a lever piece that is able to rotate between a point in which it is hidden and another position in which it stands out to become the first support of the corkscrew; so that once a first part of the cork is extracted, the user rotates the lever piece thereby situating a second support of the top piece of the corkscrew against the bottle outlet.

Again, this version requires two separate supports. A first support against the bottle neck and then a second support. This operation is very difficult to do with only one hand. All the solutions known up to now make use of a double resting point.

In accordance with the present invention, a corkscrew is proposed which solves the mentioned disadvantages through advantageous constructive and functional characteristics. Only one unique support is needed, thereby allowing the user to extract the whole cork by manipulating the corkscrew with only one hand in a very comfortable and normal way.

BRIEF SUMMARY OF THE INVENTION

The improved corkscrew of the present invention, consists of a central structure preferably made of stainless steel microfusion and embedding, a lever, a drill to be inserted in a cork and a support piece to use as leverage while uncorking, wherein the support piece is composed of a first and second piece telescopically extendible to a fixed locked position. The first and second piece can be extended by simply tilting the lever back towards the position corresponding to a uncorking operation.

This way the improved corkscrew of the present invention solves difficulties by providing for a progressive support which allows a continuous extracting action. All this is accomplished without the user having to introduce the drill into a cork for a second time. Moreover, the lever traveling length is notably increased. Another element to highlight in this new corkscrew is the disposition of the drill at a point nearer to the support allowing a more vertical displacement of the cork, thereby decreasing the risk of breakage.

It is noted that the progressive transition from a first leverage position to a second position can be carried out without altering the positioning of the support piece thereby, obviating the need for a second resting point on the support piece. This means that the solution disclosed herein substitutes the double resting point of the already known solutions for a sole progressive support, thereby allowing the user to extract the plug in a continuous way and managing the corkscrew with only one hand.

In one embodiment of the present invention a grip made of wood, plastic or any other similar material is disposed on the central structure. The grip conforms to the structure, and has a rounded shape, wherein the surface of the grip is designed to be non-skid.

This corkscrew therefore has advantageous characteristics, and has preferable features over known corkscrews.

DETAILED DESCRIPTION OF THE INVENTION

Figure 1:
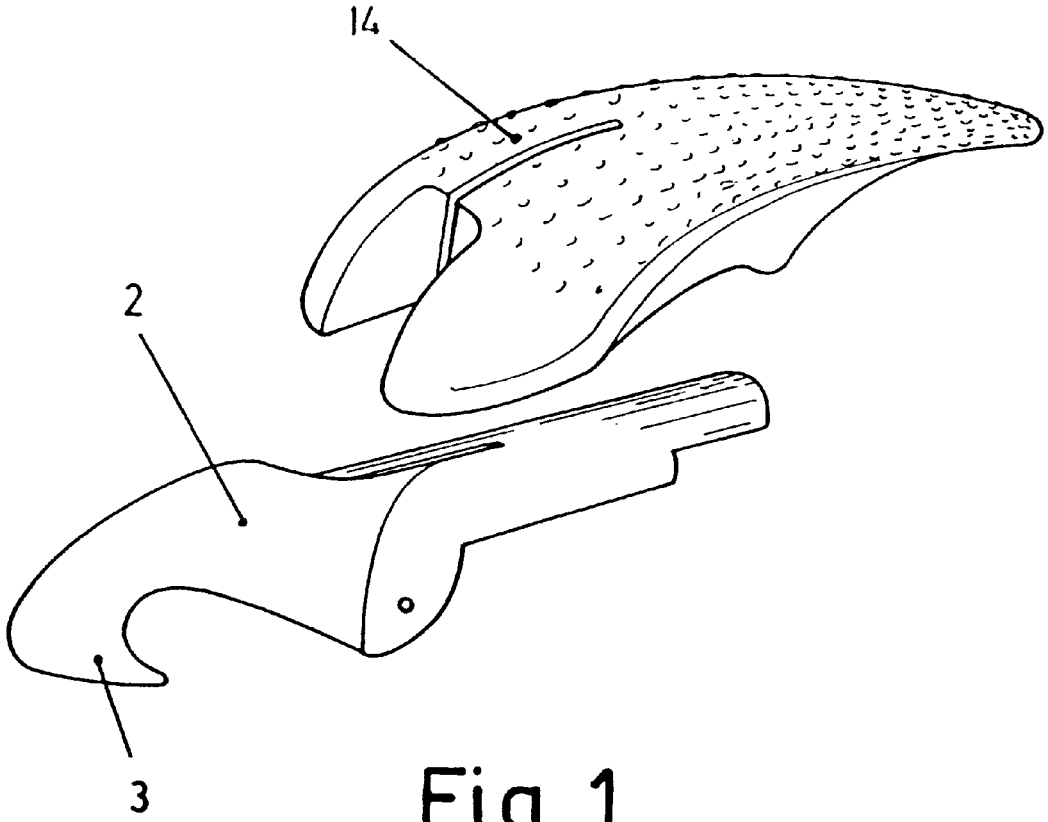
FIG. 1 is an exploded perspective including the grip and lever of the improved corkscrew.
Figure 2:
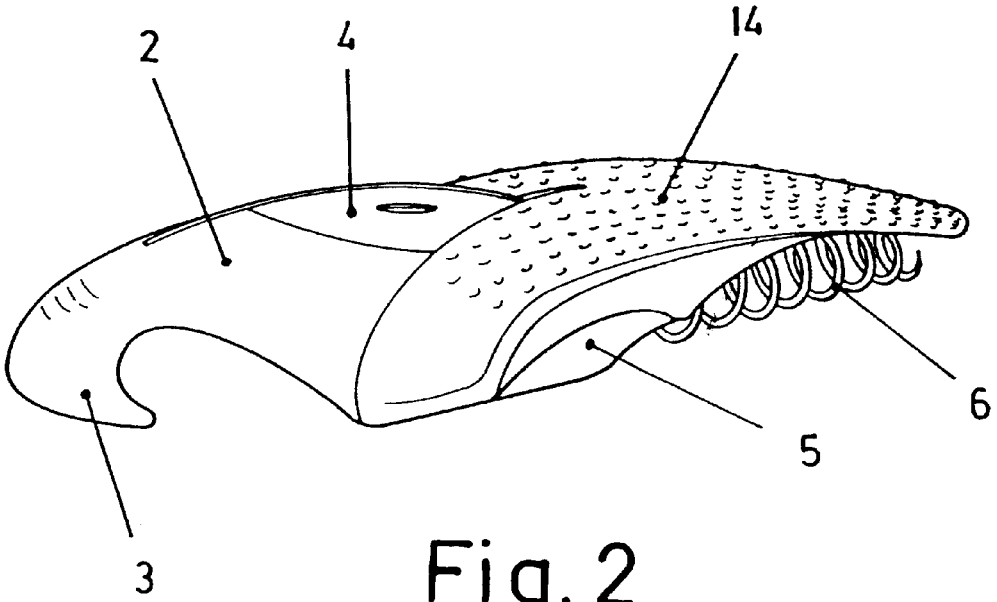
FIG. 2 is a perspective of the complete corkscrew in a retracted position.
Figure 3:
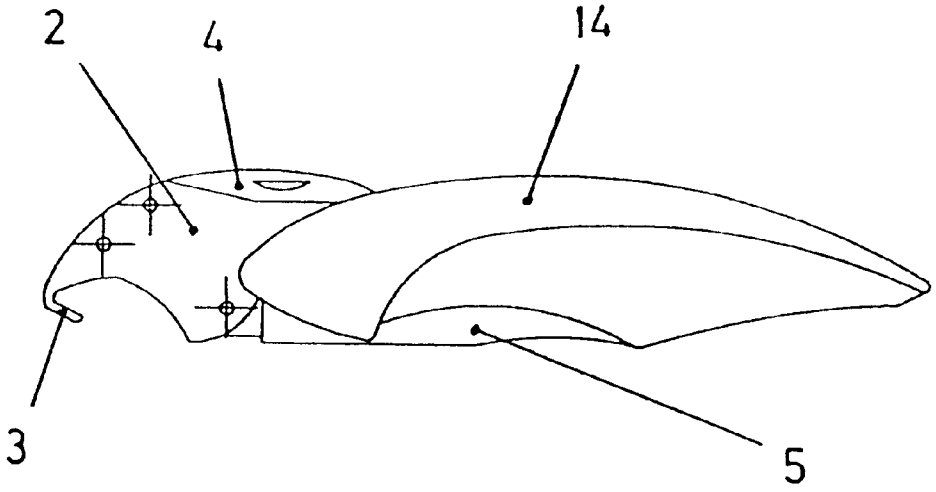
FIG. 3 is a side view of the corkscrew of FIG. 2 in the retracted position.
Figure 4:
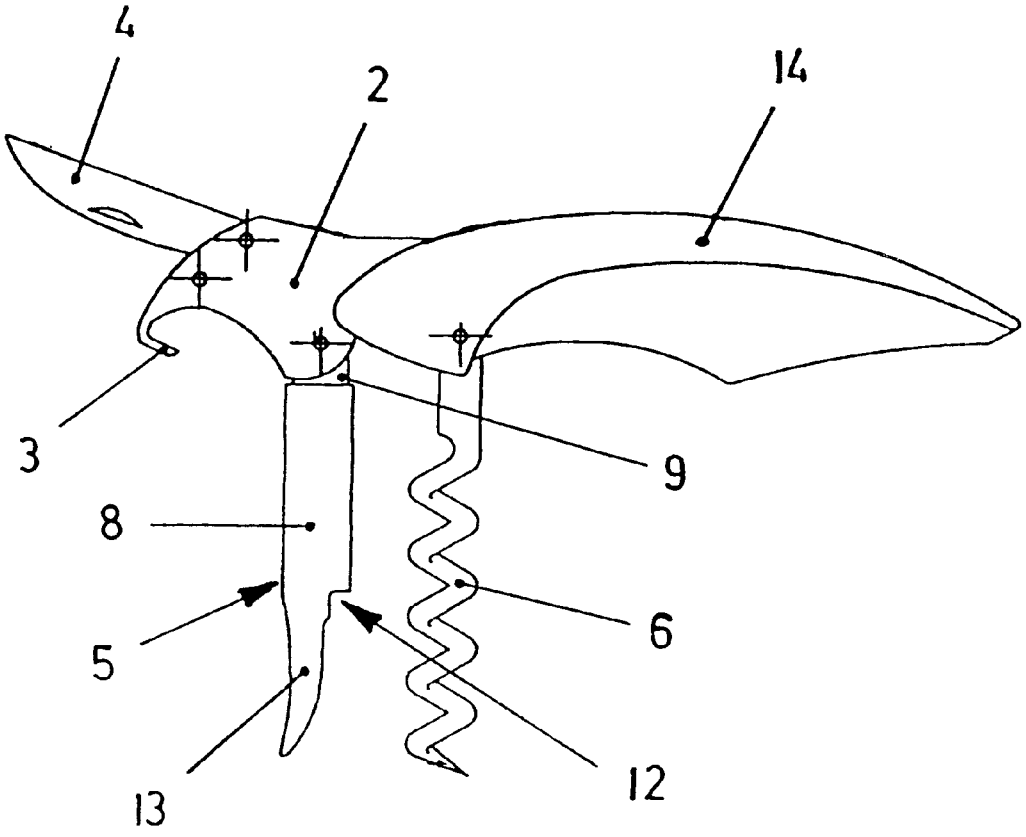
FIG. 4 is a side view of the corkscrew in an opened position.

The present invention refers to a manual corkscrew and particularly to the type of leverage required on the edge of an outlet of a bottle (1) to be uncorked.

The corkscrew, comprises a central structure (2), which can be made of stainless steel microfusion and embedding, which can also have a nail-like conformation (3) used to open crown plugs disposed on a front part of the central structure. Additionally, a lever (14) is hingedly attached to the central structure (2) and the support piece (5).

The improved corkscrew may also have on a front part of the central structure (2) a cutting element (4), the cutting element (4) being an auxiliary means to remove the sealing cover of the bottles before their uncorking.

Disposed on a lower part of the central structure (2) are a support piece (5) for leverage support on the outlet of the bottle (1) and a drill (6).

In particular, the support piece (5) contains an extensible set of a first piece (8) and a second piece (9). On an interior wall of the second piece (9) a flexible element (10) is included, pushing a boss (11) which can be fitted through holes corresponding to both the first and second pieces (8) and (9), locking the first and second piece in an extended position.

Figure 5:
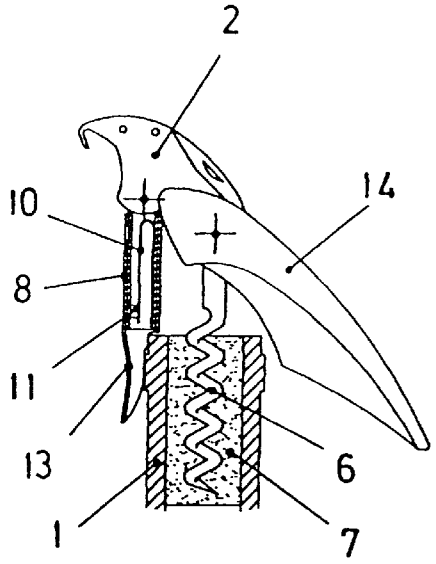
FIGS. 5, 6, 7 and 8 are perspective views of an uncorking sequence of the improved corkscrew.

To uncork, the drill (6) is inserted into the cork (7) to be extracted, and the support piece (5) is supported by means of a notch (12) corresponding to the outlet of the bottle (1), with the first and second piece (8)–(9) engaged in an unextended position, in the way represented in FIG. 5.

Figure 6:
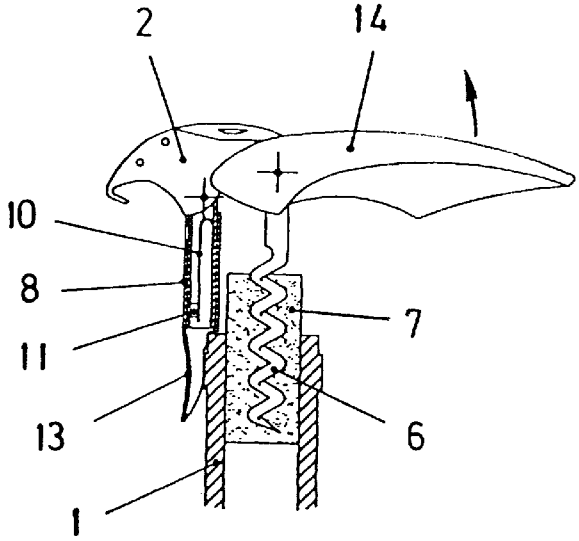

Next, a cork extraction motion is carried out by applying force in a upward motion, as shown in FIG. 6, till the force applied stops being effective.

Figure 7:
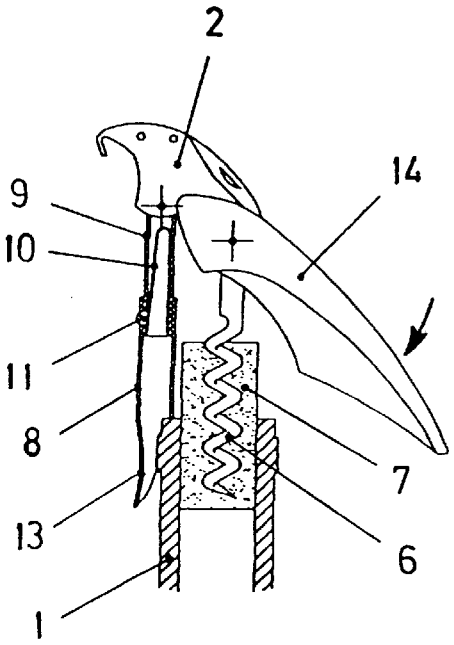

Maintaining the position of the tool at its upmost position, the lever (14) is subsequently tilted down, while maintaining the first piece (8) of the support piece (5) resting on the outlet of the bottle (1) as represented in FIG. 7. In this manner, the first and second pieces (8) and (9) of the support piece (5) are extended until the boss (11) blocks the holes of the first and second pieces.

Figure 8:
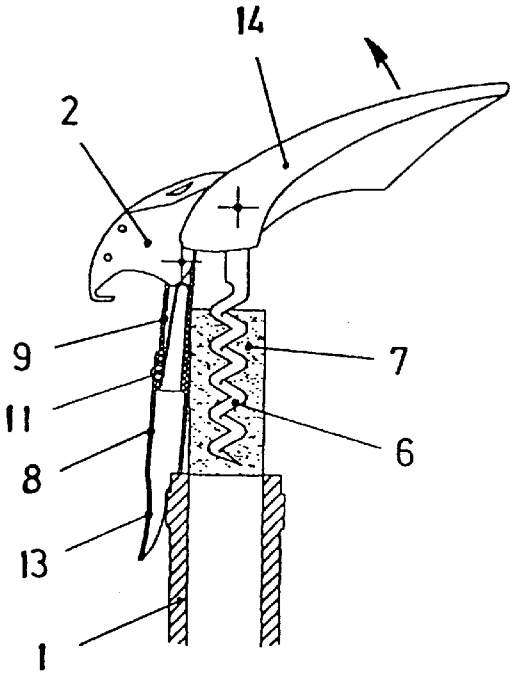

In this way, force can again be applied upwards onto the lever (14) as represented in FIG. 8, without having to drill further and without having to change the resting point of the notch (12) of the support piece (5) against the bottle outlet at any time.

Thus, the improved corkscrew of the present invention provides great comfort and efficiency during uncorking without having to perforate the cork (7) completely with the drill (6). Additionally, the present invention avoids bits of cork (7) from falling into the bottle (1) because the double progressive uncorking action allows the drill (6) and the support piece (5) to remain relatively near the cork (7) thereby allowing extraction to be carried out without any lateral effort.

In one embodiment of the present invention, the first piece (8) of the support piece (5) has a lug (13) used to support the user's finger, allowing the user a comfortable and effective way to support the notch (12) on the outlet of the bottle (1), as well as the retention of the first piece (8) during the extension phase of the support piece (5) for the second extracting action.

Once the uncorking operation is carried out, the first and second pieces (8)–(9) of the support piece (5) can be retracted again. Unlocking the boss (11) from the extended position retracts the first and second pieces (8)–(9) when the boss (11) is not engaged.

The critical aspect of the invention resides in the telescopic feature of the support piece (5). One of ordinary skill in the art can adopt the most convenient configuration without altering the telescopic aspect of the present invention. Accordingly, the first and second pieces (8)–(9) can be built up of plied plate; or from tubular elements or even by means of moulded pieces.

In the same way, one of ordinary skill in the art would understand that a boss is only a non limitative example of retaining the first and second pieces (8)–(9) in their extended position. This extension can be carried out through other means already used in telescopic connections such as elastic rings, ratchets, lever cuttings of one of the parts (8) or (9) without modifying the object of the present invention.

In yet another embodiment of the invention, a grip (14) is incorporated on the structure (2), made of wood, plastic or other similar materials and having a rounded shape. The mentioned structure (14) can have a non-skidding configuration on its surface, for instance a base of small projections or hollows, easing up the effort to be carried out for the uncorking action.

In one embodiment of the present invention, a nail-like device (3) and the cutting element (4) is configured on the structure (2) both at the same end of the tool to allow advantageous use of the cutting element (4) without the user having to change hand position from the uncorking operation.

What is claimed is:

1. An improved corkscrew, comprising:

a central structure a lever grip mounted to said central structure at a first end thereof;

a helicoidal drill pivotally connected to a bottom side of said central structure;

a support piece pivotally connected to said central structure on another end thereof opposite the first end and having an interior region therein, said support piece comprising a first part and a second part that are mutually telescopically extendable between an unextended position and an extended position; and a mobile pin disposed in the interior region of the support piece, said mobile pin being engageable with each of said first and second parts of said support piece thereby locking said first and said second parts into the unextended and the extended position.

2. The improved corkscrew as claimed in claim 1 further comprising a plurality of mutually corresponding holes in each of said first and second parts of said support piece into corresponding ones of which said mobile pin is mutually engageable.

3. The improved corkscrew as claimed in claim 1 wherein the telescopic extension of said support piece between the unextended and extended positions is progressive.

4. The improved corkscrew as claimed in claim 1 further comprising a flexible element disposed in the interior region, said flexible element biased against said mobile pin.

5. The improved corkscrew as claimed in claim 1 further comprising a cutting element mounted on said central structure.

6. The improved corkscrew as claimed in claim 5 wherein said cutting element is a knife-like blade.

7. The improved corkscrew as claimed in claim 5 wherein said cutting element is pivotally connected to said central structure.

8. The improved corkscrew as claimed in claim 5 wherein said cutting element is disposed on a front portion of said central structure.

9. The improved corkscrew as claimed in claimed 1 further comprising a hook having a nail-like protuberance mounted on said central structure.

10. The improved corkscrew as claimed in claim 1 wherein an outer one of said first and second parts of said support piece has a support notch disposed thereon.

11. The improved corkscrew as claimed in claim 1 wherein said central structure is stainless steel.

12. The improved corkscrew as claimed in claim 1, further comprising an anti-skid configuration on a surface of said lever grip.

13. The improved corkscrew as claimed in claim 1 wherein said lever grip is made of wood or plastic.

* * * * *